United States Patent [19]

Seragnoli

[11] 4,208,854

[45] Jun. 24, 1980

[54] DEVICE FOR FOLDING BLANKS OF SHEET MATERIAL IN MACHINES FOR PACKAGING ARTICLES, PARTICULARLY CIGARETTES, INTO HINGED-LID PACKETS

[75] Inventor: Enzo Seragnoli, Bologna, Italy

[73] Assignee: G.D Società per Azioni, Bologna, Italy

[21] Appl. No.: 945,807

[22] Filed: Sep. 26, 1978

[30] Foreign Application Priority Data

Sep. 26, 1977 [IT] Italy ..... 3559 A/77

[51] Int. Cl.[2] ..... B65B 11/28

[52] U.S. Cl. ..... 53/575; 53/207; 53/234; 53/462

[58] Field of Search ..... 53/575, 207, 225, 230, 53/234; 93/12 C

[56] References Cited

U.S. PATENT DOCUMENTS

| | | | |
|---|---|---|---|
| 1,091,684 | 3/1914 | McGirr | 53/234 |
| 2,642,707 | 6/1953 | Sandberg | 53/225 X |
| 3,006,119 | 10/1961 | Fingerhut | 53/230 X |
| 3,793,545 | 6/1973 | Lattke | 53/575 X |
| 3,802,325 | 4/1974 | Bardenhagen et al. | 93/12 C X |
| 3,977,157 | 8/1976 | Davies et al. | 53/234 X |
| 4,044,528 | 8/1977 | Black et al. | 53/234 X |
| 4,084,393 | 4/1978 | Focke | 53/207 X |

*Primary Examiner*—John Sipos

*Attorney, Agent, or Firm*—H. Dale Palmatier

[57] ABSTRACT

In a machine for packaging articles, in particular cigarettes, an apparatus for folding cutout elements to obtain packets of the hinged-lid type, the apparatus comprising a drum adapted to rotate in a stepped manner and having peripheral recesses each adapted to receive a respective article and to displace the same along a plurality of folding stations, at the first of said stations a first folding operation being performed by simultaneously inserting said articles and the respective cutout elements into the respective recesses; at the last of said stations a last folding operation being performed by ejecting said articles and the respective cutout elements through an aperture; and the intermediate stations comprising fixed cam means engaging said cutout elements during movement of said drum, and mobile folding means engaging said cutout elements when the drum is stationary.

14 Claims, 10 Drawing Figures

DEVICE FOR FOLDING BLANKS OF SHEET MATERIAL IN MACHINES FOR PACKAGING ARTICLES, PARTICULARLY CIGARETTES, INTO HINGED-LID PACKETS

BACKGROUND OF THE INVENTION

The present invention relates to an apparatus for folding cutout elements in machines for packaging articles, particularly cigarettes, to obtain rigid packets of the hinged-lid type.

A packaging machine is known in the art, in which cutout elements having pre-formed folding lines are folded onto respective articles to be packaged while being stepwise moved along a circular path by means of a wheel having along its outer periphery a plurality of radial receiving recesses or pockets. In the above-mentioned known machine, a cutout element together with a respective article is loaded onto the said wheel at two different positions spaced from each other at least one feed step on the said wheel. More particularly, at the first of the said two positions, which is termed below "insertion position", cutout elements are sequentially inserted into respective pockets by means of a slide support which is cyclically movable in radial direction with respect to the said wheel and comprises three sliders movable with respect to one another in the direction of movement of the slide. During the insertion operation, each cutout element is folded by the combined action of fixed folding members and the side walls of its respective pocket, while being pushed by the said slide, so as to completely cover its respective pocket. More particularly, at the end of the insertion operation each cutout element is arranged with its central panel forming the rear portion of the packet in contact with the bottom surface of the said pocket, with two side panels, each forming a side inner stiffening panel, in contact with the lateral surfaces opposite to the said pocket and disposed parallel to the axis of the said wheel, with two longitudinal panels the first of which is a top panel and the second a bottom panel of the packet, in contact with opposite side surfaces of the said pocket arranged perpendicularly to the axis of the said wheel, and with two pairs of inner stiffening flaps folded in contact with the inner surfaces of the said top panel and the said bottom panel, respectively. Thus, at the end of the insertion operation two panels designed to form the rear wall and the lateral side walls of the packets project from the said pocket in opposite directions and parallel to the axis of the said wheel.

At the second of the two said positions, the articles to be packaged are supplied to the inside of their respective covered pockets in the previously described manner by means of respective cutout elements and are then moved forwards by the wheel towards a discharge station at which folding of the cutout elements is terminated during ejection of the packets partially formed by their respective pockets.

From the above one can note that the principles according to which the structure of the packaging machine operates are mainly in accordance with the above described known art, on the one hand, the insertion of cutout elements and loading of articles to be packaged in two successive times and, on the other hand, effecting most of the folding operations during insertion of the cutout elements.

SUMMARY OF THE INVENTION

The two above-mentioned operating principles, although valid for relatively low production speeds, are unsatisfactory when relatively high production speeds, i.e. of the order of 300 to 400 packets per minute, are to be attained. The said wheel has to stop for relatively long time intervals between successive feed steps since all the folding operations which are performed during the insertion operation must be allowed to be correctly performed. In other words, optimum advantage is taken of each stopping or dwell of the wheel only at the said insertion position, while the operations carried out at successive positions take a relatively small portion of the same dwell. Furthermore, feeding of articles inside the partly folded cutout elements already inserted into respective pockets in the said wheel may bring about notable drawbacks since even a small deformation in the folded cutout elements, such as a slight inclination inwards of the said stiffening flaps of the bottom and top panels of the packets, could prevent correct insertion of the articles to be packaged.

An object of the present invention is to provide an apparatus for folding cutout elements, in which, on the one hand, the folding operations are better distributed so as to reduce to a minimum the dwelling time between successive feed steps of a conveyor member for the cutout elements and their respective articles and, on the other hand, the articles are loaded on the said conveyor member simultaneously with their respective cutout elements so as to eliminate any difficulties in combining the cutout elements with a respective article or product to be packaged.

The above object is attained by the present invention in that there is provided a folding apparatus for cutout elements in machine for packaging articles, in particular cigarettes, to obtain rigid packets of the hinged-lid type, which apparatus comprises in combination a drum having on its outer periphery a plurality of recesses open both towards the outside of the drum and in the direction parallel to the axis of the drum, the said drum being rotatable step-by-step about its own axis to move each of the said recesses from a loading position to an unloading position; a fixed folding mandrel arranged externally of the said drum at the said loading position to define a passage having a cross-section substantially equal to that of the said articles and the said recesses, the said mandrel oriented in radial direction with respect to the said drum; loading means for successively feeding, when the drum is at rest, each of the said articles inside a respective recess together with a respective cutout element disposed with its central portion between the mandrel and the said recess to perform a first folding operation on the said cutout element; fixed folding means and cyclically movable folding means for carrying out further folding operations on the said cutout elements when the said drum is in motion and at rest or stationary, respectively; fixed end folding means for carrying out a final folding operation on the said cutout elements when the daid drum is stationary; and discharge or unloading means for successively ejecting the said formed packets from their respective recesses in the said drum and pushing them in engagement with the said final or end folding means; the said loading means comprising a first mobile folder or pusher reciprocating in radial direction with respect to the drum and through a drum recess arranged in front of the said mandrel, the said pusher having a folding head adapted to engage the said mandrel to fold, in contact with the outer surface thereof, side portions of the said cutout element projecting outwards from the said mandrel in a direction perpendicular to the axis of the said drum; a second pusher co-axial with the said first pusher and designed to reciprocate to successively feed the said articles to be packaged inside the said mandrel and to move in time relationship with the said first pusher in engagement relationship with the said mandrel so as to feed each article and its respective partly folded cutout element inside its respective recess; and a support element cyclically movable in a substantially tangential direction with respect to the said drum to support each article and its respective cutout element inside the said recess at the said loading position, the said support element having arms designed to co-operate with parts of the said side portions of each of the said cutout elements projecting from their respective recess at the said loading position in an axial direction with respect to the drum; and the said fixed folding means comprising cam means defining a cylindrical helix coaxial with the said drum and arranged to engage with an end portion of a part of the said cutout elements which projects from the said recesses in axial direction with respect to the drum, and to fold it towards the drum so as to arrange it in a plane substantially perpendicular to the axis of the drum.

BRIEF DESCRIPTION OF THE DRAWINGS

Further characteristics and advantages of the present invention will appear from the following description with reference to the accompanying drawings which illustrate a non-limiting embodiment thereof, in which drawings.

DETAILED DESCRIPTION OF THE DRAWINGS

Figure 1:
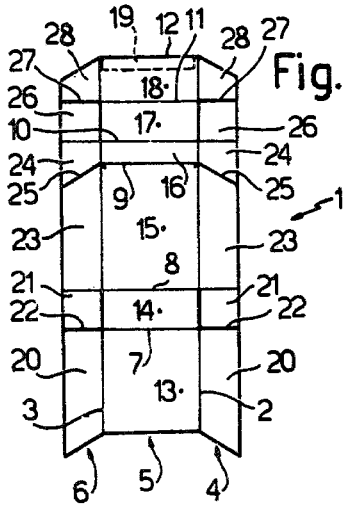
FIG. 1 is a plan view of a cutout element suitable for being folded along pre-formed folding lines to obtain a rigid packet of the hinged-lid type.

FIG. 1 is a plan view of a cutout element 1 known per se having a substantially rectangular cinfiguration with a plurality of pre-formed folding lines along which the cutout element 1 can be folded to form a rigid packet of the hinged-lid type. More particularly, the cutout element 1 has two longitudinal folding lines 2 and 3 which subdivide the cutout element 1 into three longitudinal strips 4, 5 and 6 and six transverse folding lines 7, 8, 9, 10, 11 and 12, the line 9 being a hinge line extending transversely of the lines 2 and 3. The said transverse folding lines 7 to 12 define in succession along the intermediate strip 5 a first front panel 13, a bottom panel 14 and a first rear panel 15 of the said packet, a second rear panel 16, an upper or top panel 17 and a second front panel 18 of the lid of the said packet, and an end flap 19 folded underneath the panel 18 and pre-glued thereto in accordance with a method known per se. Along each longitudinal side strips 4 and 6 the lines 7 and 8 and 10 and 11 define a first side panel 20, a first stiffening flap 21 of the panel 14, which flap is delimited by a cut 22 extending along the line 7 and along its respective line 2 or 3, a first side stiffening panel 23, a second side stiffening flap 24 separated from the panel 23 by a cut 25 extending obliquely from the end of the line 1, a further or second side stiffening flap 26 delimited by a cut 27 extending along the line 19 and its respective line 2 or 3, and a lateral or second side panel 28 of the said lid.

Figure 2:
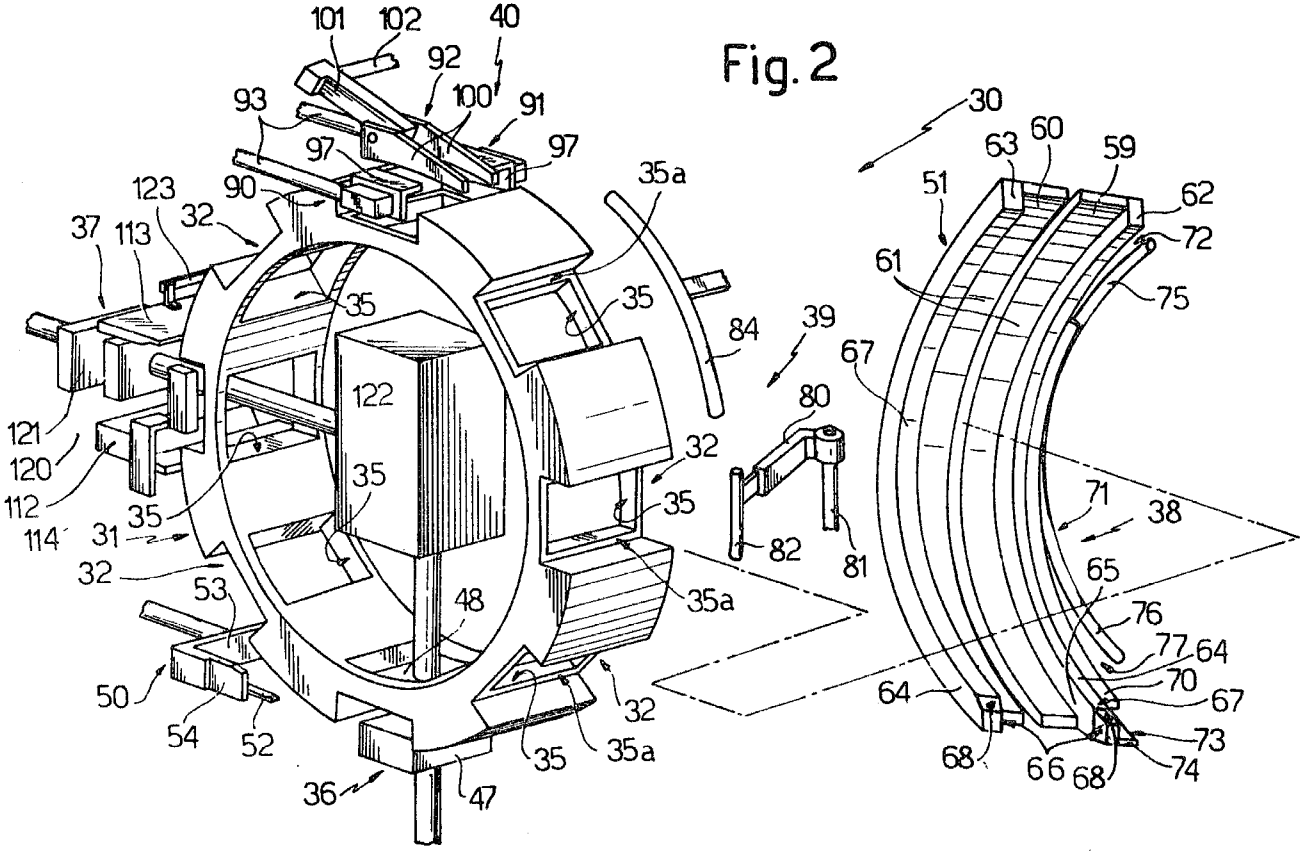
FIG. 2 is a diagrammatic perspective view, with parts cut away for clarity, of a folding apparatus in accordance with the present invention.

FIG. 2 diagrammatically shows a folding apparatus 30 for folding cutout elements 1 which are successively fed thereto to form the same number of packets of the hinged-lid type.

The apparatus 30 is a part of a machine (not shown) for packaging articles, cigarettes in the embodiment shown, in packets of the hinged-lid type, the apparatus comprising a central rotatable member which constitutes a drum conveyor or a conveying drum 31 adapted to rotate step-by-step about its central axis to feed step-by-step the said cutout elements 1 to be folded and cigaretted to be packaged along a substantially circular path. To this end, the drum 31 has an annular configuration and possesses along its outer periphery a plyrality of radially extending recesses 32 of substantially rectangular cross-section and having dimensions such that each recess is adapted to receive a respective cigarette packet being formed.

Figure 8:
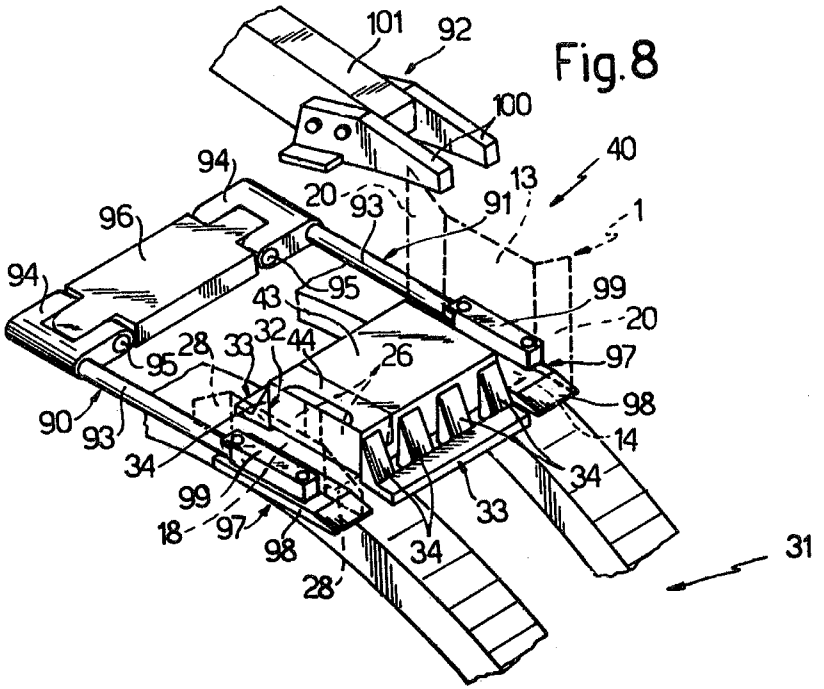
FIG. 8 is a diagrammatic perspective view, with parts cut away for clarity, of an embodiment of a fourth folding station of the apparatus of FIG. 2.

In the embodiment illustrated in FIG. 2, the recesses 32 are diagrammatically illustrated in the form of axial seats or grooves formed on the outer periphery of the drun 31. In practice, each recess 32 is preferably obtained, as shown in FIG. 8, by means of axially extending comb-members 33 connected to the outer periphery of the drum 31 and each having a plurality of teeth 34 radially extending outwards.

Each recess 32 is open both outwards and at its axial ends and communicates inwardly with a respective radial through-opening 35 (FIG. 2) formed in the drum 31 and having a cross-section smaller than that of the recess 32 so as to define, at the bottom of the recess, a rest seat 35*a* for the packets being formed.

Figure 3:
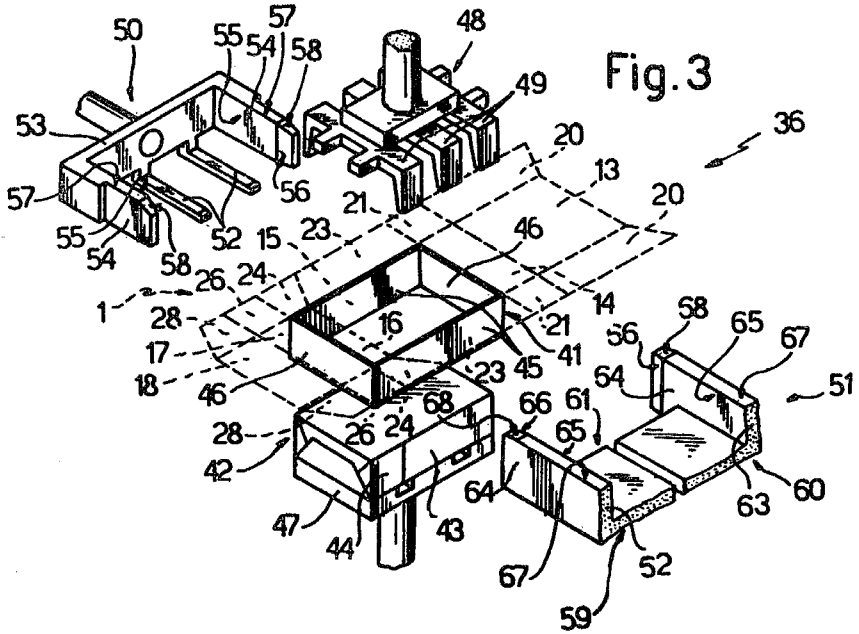
FIG. 3 is a diagrammatic perspective view, with parts cut away for clarity, of an embodiment of an inlet or loading and first-folding station of the apparatus of FIG. 2.

As shown in FIG. 2, the said circular path extends from an insertion or loading station 36 towards an outlet or unloading station 37 through a plurality of fixed folding stations generally indicated at 38, 39 and 40, respectively, at which stations each cutout element 1 is subjected to successive folding operations. The station 36 shown in FIG. 2 and in more detail in FIG. 3 comprises a mandrel 41 carried by supporting means not shown in a fixed position outside the drum 31 (which is not shown in FIG. 3) so as to be in alignement with one of the recesses 32 at the end of each feeding step of the drum 31. The mandrel 41 substantially comprises a rectangular frame made of metal sheet arranged in a plane perpendicular to a radius of the drum 31 and having a cross-section subtantially equal to that of the recesses 32 so as to suitable to receive inside thereof a non-lined packet 42 os cigarettes, i.e. a packet having only an outer wrapping lining 43 of tin foil and an outer front collar 44. In particular, the mandrel 41 comprises two major transverse side walls 45 parallel to the axis of the drum 31 and arranged at a distance from each other substantially equal to the distance between the folding lines 2 and 3, and two minor longitudinal side walls 46 arranged at a distance from each other substantially equal to the distance between the folding lines 8 and 10. The station 36 also comprises a first pusher or elevator 47 arranged outside the drum 31 and being adapted to reciprocate in a radial direction with respect to the drum and through the mandrel 41 under the action of driving means not shown, and a second pusher or "counterelevator" 48 which is arranged in alignement with the elevator 47 and can reciprocate in the same direction as the elevator 47 through the recess 32 and the opening 35 aligned, at each step, with the mandrel 41. In the embodiment illustrated in FIG. 3, the counterelevator 48 has at its free end, a folding head comprising a plurality of U-shaped folding forks arranged in planes perpendicular to the axis of rotation of the drum 31 and designed to engage at their arms with the outer surface of the major walls 45 of the mandrel 41.

Laterally of the elevators 47 and 48, there are, on the one hand, a mobile support member comprising a fork member 50 and, on the other hand, a fixed guide generally indicated at 51. The fork member 50 can reciprocate under the action of driving means, not shown, perpendicularly to the axis of the drum 31 and the direction of movement of the elevators 47 and 48, and comprises two arms 52 designed to follow, during the movement of the fork member 50, trajectories which are substantially tangent to the outer surface of the drum 31. The arms 52 are rigidly connected to the core of a U-shaped folding frame 53 whose arms, generally indicated at 54, extend parallel to the arms 52 and substantially in the same plane as the minor surfaces 46 of the mandrel 41. Each arm 54 has a substantially planar inner surface 55 which has at its free end a bevel 56 and a side surface 57 facing the drum 31 and provided, at its free end, with a bevel 58.

The guide 51 comprises two curved elements 59 and 60 parallel to each other and supported at a fixed position by support means, not shown. The two elements 59 and 60 form together a cylindrically curved plate 61 which extends substantially in contact with a portion of the outer periphery of the drum 31 so as to close the outer open end of the recesses 32 thereof.

The plate 61 has two annular side members 62 and 63 which are arranged facing the opposite axial ends of the drum 31 and project, at one end thereof, from the plate 61 so as to form two arms 64 identical to the arms 54 and in alignement with them. Similarly to the arms 54, the arms 64 are also limited by a respective side planar surface 65 having a bevel 66, and by an inner cylindrical surface 67 having a bevel 68.

Figure 5:
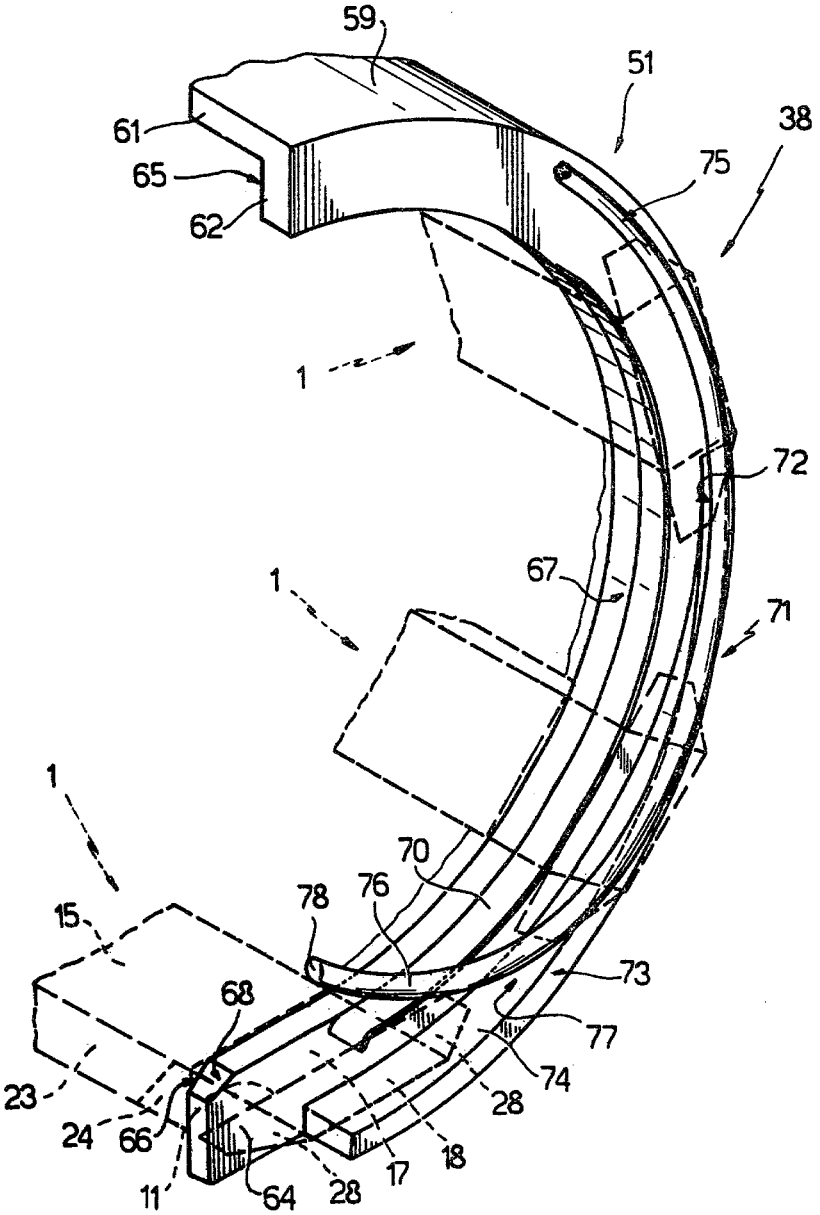

The guide 51, and in particular the side member 62 of the element 59 thereof, forms a support for the station 38 which comprises a mandrel 70 and a folding cam 71. More particularly, as illustrated in FIG. 5, the mandrel 70 comprises a metal strip co-planar with the inner surface 67 of the side member 62 and extends axially with respect to the member 62 in a direction opposite to the plate 61. The mandrel 70 extends to a central portion of the guide 51 starting from a point of the guide close to the arms 64 and has a width such as to define, together with the inner surface 67 of the side member 62, a cylindrical surface having a width substantially equal to that of the panel 17 of the cutout element 1.

The cam 71 comprises a slit 72 which extends along a cylindrical helix co-axial with the mandrel 70 and having a radius greater than that of the mandrel 70, and is delimited, on the one hand, by an inclined end surface 73 of a cylindrical side member 74 extending along an arc of circumference co-axial with the plate 61 and arranged parallel to and facing an initial portion, in the direction of rotation of the drum 31, of the mandrel 70 and, on the other hand, by a rod 75 rigid with the side member 62 and extending, at least at its initial portion, in a plane parallel to that of the surface 73. The rod 75 comprises a central portion facing the surface 73 and extending along an arc of circumference co-axial with the plate 61, and an initial portion, indicated at 76, which is arranged adjacent to the arms 64 and having a radius of curvature smaller than that of the side member 74 so as to define, together with the side member 74, an initial portion or tapered mouth 77 of the slit 72 in a plane perpendicular to the axis of the drum 31. In other words, the slit 72 extends not only around the the drum 31 along the said cylindrical helix but also around itself since its mouth 77 extends in a plane perpendicular to the axis of the drum 31, while its intermediate portion extends along a cylindrical surface co-axial with the drum 31.

As illustrated in FIG. 5, the distance between the side member 74 and the axis of the drum 31 is greater than the distance between the drum 31 and the seats **35*a*, while the curvature of the portion 76 of the rod 75 is such that the initial end, indicated at 78, of the rod is arranged radially with respect to the axis of the drum 31 inside not only the surface 67 of the side members 62 but also the seats 35*a* whose distance from the axis of the drum 31 is slightly smaller than that from the surface 67**.

So far as the slit or slot 72 is concerned, it should be noted that only a first portion thereof has a helical configuration. As illustrated in FIG. 5, the side member 74 extends only to about a first half of the guide 51 starting from its end adjacent to the arms 64, while the rod 75 substantially extends over the entire length of the guide 51.

Consequently, beyond the end of the side member 74 at which the surface 73 merges with the outer lateral surface of the side member 62, the slit 72 extends along the side member 62 and parallel thereto.

Figure 6:
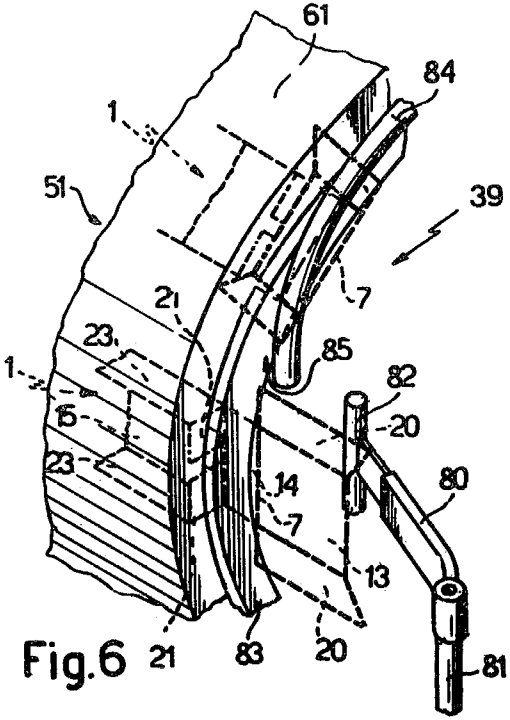
FIGS. 5 and 6 are diagrammatic perspective views, with parts cut away for clarity, of an embodiment of a second and a third folding station of the apparatus of FIG. 2.

The folding station 39 is supported by the guide 51 dowstream of the station 38 in the direction of rotation of the drum 31 and comprises, as illustrated in FIG. 6, a folding lever 80 arranged in front of the side member 63 and keyed on a drive shaft 81 to rotate therewith with reciprocating motion in a diametral plane of the drum 31. At its free end, the lever 80 is connected to a cylindrical body 82 which, during the movement of the lever 80, moves along a trajectory substantially tangent to the outer side surface of a folding mandrel 83. The mandrel 83 comprises a metal strip having one side surface arranged in a position co-planar with the surface 67 of the side member 63 so as to delimit together with the surface 67 a cylindrical surface having a width substantially equal to that of the panel 14 of the cutout element 1.

Finally, the folding station 39 comprises a fixed rod 84 arranged downstream of the lever 80 and extending along the mandrel 83 to delimit with it a slit or slot 85 extending in a plane perpendicular to the axis of the drum 31. The folding station 40, illustrated in detail in FIG. 8, is arranged, in the direction of rotation of the drum 31, immediately downstream of the end of the guide 51 opposite to that carrying the arms 64 and comprises two folding members 90 and 91 arranged (see FIG. 2) side by side laterally of the drum 31 and on opposite sides thereof, and a pressing member 92 arranged between the said folding members 90 and 91 and facing the outer periphery of the drum 31. Each folding member 90, 91 comprises a rod 93 perpendicular to the axis of the drum 31 and extending in a plane substantially tangent to the outer periphery thereof. A fork-like extension 94 laterally extends frome one end of the rod 93 and is rotatably mounted, by means of a pin 95 parallel to the rod 93, on a fixed plate 96 acting as a common support for the members 90 and 91. An angle member 97 is carried and rigidly connected to each member 90, 91 at the end of its respective rod 93 opposite to that carrying the extension 94, the angle member 97 being designed to be moved into contact with a cutout element 1 placed in the station 40.

In the embodiment illustrated in FIG. 8, each angle member 97 comprises a plate 98 and a bar 99 opposite to the plate 98, the plate 98 and the bar 99 being connected to a respective rod 93. The plate 98 has transverse dimensions greater than those of the rod 99 so as to define together with it a right dihedral.

The pressing element 92 comprises a sliding block 100 rigidly connected to one end of a lever 101 extending in a plane perpendicular to the axis of the drum 31 and keyed on a drive shaft 102 (FIG. 2) to reciprocate with it under the action of driving means, not shown, to and fro the outer periphery of the drum 31.

The outlet or unloading station 37 is arranged downstream of the station 40 in the direction of rotation of the drum 31 and comprises a folding hopper 110 facing the outer periphery of the drum 31 and defining a passage 111 having a cross-section substantially identical to that of the recesses 32 and extending radially with respect to the drum 31. The passage 111 is delimited by two superimposed plates 112 and 113 arranged in a substantially radial position with respect to the drum 31, and two further plates 114 and 115 parallel to each other and extending in planes perpendicular to the planes containing the plates 112 and 113 and to the axis of the drum 31.

Each plate 112, 113 has on their side facing drum 31, two inclined surfaces 116 and 117 having an increasing inclination, while the plates 114 and 115 are the end elements of a pusher 118 and a pusher or "counterpusher" 119, respectively, which are both mobile in a direction parallel to the axis of the drum 31.

Figure 10:
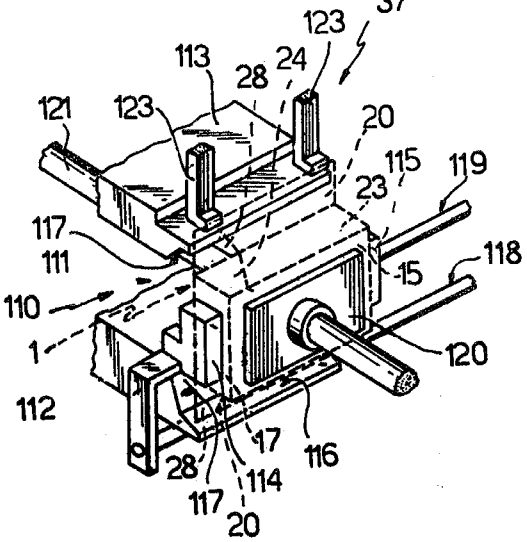
FIG. 10 is a diagrammatic perspective view, with parts cut away for clarity, of an embodiment of a final folding and unloading or discharge station of the apparatus of FIG. 2.

A first pusher 120 and a second pusher or "counterpusher" 121 are mounted for reciprocating motion along the passage 119, the pusher 120 being actuated by a driving device 122 (FIG. 2) in common with the counterelevator 48 and centrally arranged with respect to the drum 31, the device 122 being designed to move through the opening 35 and the recess 32 facing the passage 119. Two pairs of vertical arms 123 (only the upper pair being illustrated in FIGS. 2 and 10) are finally mounted transversely of and above and below the passage 119, the pairs of arms 123 being designed to cyclically move under the action of driving means, not shown, and having, as will be explained below, the function of adjustment members.

In operation, the folding apparatus 30 described above operates as follows.

As described above, the drum 31 is rotated step by step is counterclockwise direction by means of driving means, not shown in FIG. 2 and known per se, so that at the end of each step a first recess 32 is arranged in alignement with the mandrel 41, a second recess 32 is arranged adjacent to the cylindrical body 82 on the folding lever 80, a third recess 32 is arranged between the angle members 97, and a fourth recess 32 is arranged in alignement with the passage 119. In the following description, the operation of the apparatus 30 is described with reference to one cutout element 1 and starting from the moment at which the said cutout element is fed to the station 36 by means of a step conveyor, not shown and known per se, comprising, in a known manner, at least one glueing device (not shown) designed to cold spray glue on those parts of the cutout element which, during the folding operations performed by the apparatus 30, overlap and contact other parts of the same cutout element. As soon as the station 36 has been freed of one cutout element following a step forward of the drum 31, a new cutout element 1 is fed by means of the said conveyor (not shown) above the mandrel 41 and is stopped there by means of positioning and abutment means, not shown. The cutout element 1 is stopped above the mandrel 41 so that its folding lines 2 and 3 coincide with the side wall 45 of the mandrel 41 and its folding lines 8 and 10 coincide with the side walls 46 of the mandrel 41. At the same time, above the elevator 47 which is at its lower dead point below the mandrel 41 a packet 42 is fed by means of conveyor means not shown and known per se. At this point, the drum 31 stops rotating and the counterweight 48 arranged at its upper dead point inside the drum 31 descends under the action of the device 122 towards the mandrel 41, while the forks 49 pass between the teeth 34 of the comb members 33 delimiting the recess 32 in alignement with the mandrel 41. At the end of its stroke, the counterelevator 48 engages its forks 49 with the side strips 4 and 6 of the cutout element 1, thereby folding the panels 23 and the flaps 21 and 26 towards the surface of the side walls 45 of the mandrel 41. At the same time, the elevator 47 moves under the action of driving means, not shown, towards the mandrel 41, thereby inserting into it the packet 42 to bring it into contact with the counterelevator 48 with the interposition of the panels 15 and 16 of the cutout element 1. At this point, the two elevators 47 and 48 move together towards the said recess 32, thereby pushing the packet 42 and the partly folded cutout element 1 off the mandrel 41. The stroke of the elevator 47 terminates when the panels 15 and 16 are in contact with the seat 35*a*. In this position, the panel 13 and the panel 14 with their respective side walls 20, on the one hand, and the panel 17 and the panel 18 with their respective side panels 28, on the other hand, axially project from the recess 32 and on opposite sides with respect to the drum 31 in positions co-planar with the panels 15 and 16, while the panels 23 and the flaps 21 and 26 are folded at right angles towards the end of the recess 32 from which the flaps 21 and 26 axially project.

From the above it should be clear that in the apparatus 30 the cutout element is first partly folded onto the packet 42 by the mandrel 41, i.e. without applying any force to the packet 42, and is then inserted inside the recess 32 together with the packet 42, the packet 42 being joined to the cutout element 1 while the latter is being folded on the mandrel 41.

The counterelevator 48, once the panels 15 and 16 have come into contact with the seat 35*a* moves forward while leaving the cutout element 1 and returns to its rest position, the elevator 47 moving downwards only when it is replaced by the fork member 50 which, by being moved towards the guide 51 from its lateral rest position and under the action of driving means, not shown, engages at its arms 52 with the grooves formed in the elevator 47 and is placed beneath the packet 42 so as to keep the latter and its respective cutout element 1 inside the recess 32 in contact with the seat 35*a*. While the fork member 50 moves towards the guide 51, the arms 54 engage, firstly at their bevels 56 and then at their surfaces 55, with the flaps facing them, thereby folding these flaps towards the other two flaps 21 and 26 in contact with the opposite ends of the packet 42. At the same time, the arms 54 engage, firstly at their bevels 58 and then at their surfaces 57, with the panels 14 and 17 to support them in their position co-planar with the panels 15 and 16 and possibly to slightly deflect them towards the axis of the drum 31.

Figure 4:
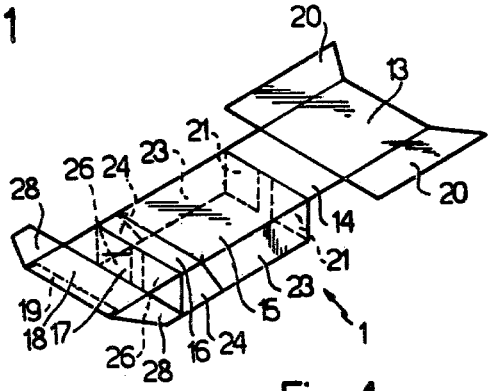
FIG. 4 is a perspective view of the cutout element of FIG. 1 folded inside the station of FIG. 3, the article being omitted for clarity of detail.

At this point, the drum 31 is rotated through a step to move forward the assembly comprising the cutout element 1 and the packet 42 towards the station 38. During an initial part of this forward movement, the said assembly 1-42 abandons the fork member 50 which then returns to its rest position, and enters the guide 51 whose arms 64 engage with the flaps 21 and 26 facing then firstly at their bevel 66 and then at their surfaces 65, thereby folding the flaps 21 and 26 towards the other two flaps 21 and 26 and thus give the cutout element 1 the shape or configuration illustrated in FIG. 4.

Contrary to what happens in all the other stations, the folding operation performed at the station 38 are carried out during the forward movement of the drum 31 and not during its dwell between one step and the next. Accordingly, the station 38 does not comprise mobile members and folds the panel 18 substantially through 90° by means of the cam 71 by taking advantage of the relative movement of the cutout element 1 moved by the drum 31 with respect to the cam 71.

As illustrated in FIGS. 5 and 6, the side members 62 and 63 of the guide 51 are arranged on opposite sides of drum 31 so as to close the opposite axial ends of the recesses 32 arranged in front of the plate 61. However, the radius of the surfaces 67 of the side members 62 and 63 is slightly greater than the radius of the seats 35*a* so that closing of the axial ends of the said recesses 32 is incomplete and the surfaces 67 delimit with each seat 35*a* two slits or slots through which extend the parts of the cutout element 1 which axially project from a respective recess 32. When in particular the cutout element 1 engages with the guide 51, the panel 14 which is kept slightly lifted by a respective arm 54 and is assisted by the bevel 68 of the side members 63, slides in contact with the surface 67, whereas the panel 13 and the side members 20 extend outside the guide 51 in axial direction with respect to the drum 31. On the opposite side the panel 17 which is also kept slightly lifted by a respective arm 44 and is assisted by the bevel 63 of the side member 62, slides into contact with the surface 67 and the inner surface of the mandrel 70 whose free edge substantially coincides with the folding line 11, whereas the panels 18 and 28 extend outside the guide 51 in axial direction with respect to the drum 31 and through the mouth 77 of the slit 72. As the mouth 77 and the remaining part of the slit 72 extend as described above in planes substantially perpendicular to each other, forward movement of the assembly 1-42 along the guide 51 results in progressive folding of the panel 18 around the free edge of the mandrel 70, and thus about the folding line 11 in contact with the rod 75. This folding action continues until the panel 18 reaches the end of the surface 73 where the panel 18 defines with the panel 17 an angle of about 90° and takes the folded position illustrated in FIG. 7.

The panel 18 is then held in this position by the rod 75 until it reaches the station 40.

As illustrated in FIGS. 2 and 5, each assembly 1-42 needs, to pass through the station 38, several advancing steps of the drum 31 and at the end of one of these steps the said assembly 1-42 is placed in the station 39 with its panel 13 facing the cylindrical body 82 of the lever 80.

At this point, while the drum 31 is at rest, the lever 80 is rotated by driving means not shown and known per se from a rest position to an operating position in which the cylindrical body 82 is aligned with the starting end of the rod 84. During this rotation the cylindrical body 82 engages the panel 13 and folds it through approximately 90° about its respective folding line 7 which substantially coincides with the free edge of the mandrel 83. During the next step forward, the folded panel 13 engages with the slit 85 while sliding in contact with the rod 84 which replaces the cylindrical body 82, thereby making it possible for the lever 80 to return to its rest position, and holds the panel 13 in its folded position until the assembly 1-42 reaches the station 40. Thus, the cutout element has, at the outlet of the stations 38 and 39, the shape illustrated in FIG. 7.

Figure 7:
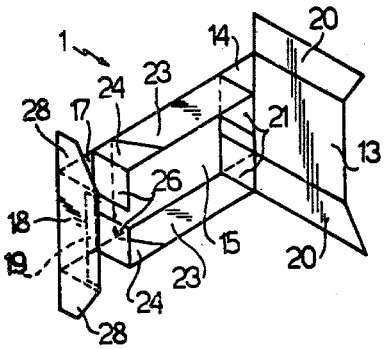
FIG. 7 is a perspective view of the cutout element of FIG. 1 as folded at the outlet of the station shown in FIG. 6, the article being omitted for clarity of detail.
Figure 9:
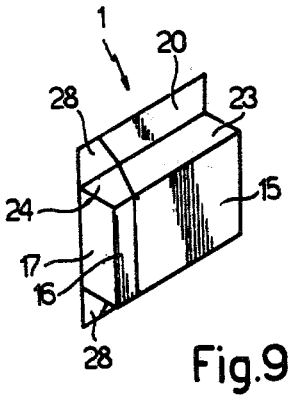
FIG. 9 is a perspective view of the cutout element of FIG. 1 as folded at the outlet of the station of FIG. 8.

When the partially folded cutout element 1, as illustrated in FIG. 7, desengages from the slits 72 and 85 and is stopped at the end of a forward step of the drum 31 at the station 40, the folding members 90 and 91 and the pressing member 92 are in the resting position illustrated in FIG. 8, in which position the pressing member 92 is arranged at a given distance from the outer periphery od the drum 31 and one of the two surfaces of each of the two dihedrals defined by the angle members 97 of the folding members 90 and 91 is substantially co-planar with the seat 35*a* arranged therebetween, whereas the other of the said two surfaces is substantially perpendicular to the axis of the drum 31 and co-planar with the outer generatrix of its respective rod 75, 84 against which slides a respective panel 18, 13. In other words, when the assembly 1-42 stops at the station 40, the two surfaces of the angle member 97 of the element 90 are arranged in contact with a respective panel 17, 18, whereas the two surfaces of the angle member 97 of the element 91 are in contact with a respective panel 14, 13. The two angle members 90 and 91 are then rotated through 90° by driving means not shown and known per se until they reach the operating position illustrated in FIG. 2, thereby causing rotation through 90° of the panels 14 and 17 about their respective folding lines 8 and 10 and folding over of the panels 13 and 18 above the packet 42 to the position illustrated in FIG. 9.

The panels 13 and 18 are kept in this position by the pressing member 92 which is moved by means of driving means not illustrated and known per se to its operating position illustrated in FIG. 2, thereby making it possible for the folding members 90 and 91 to return to their rest position. During the next step forward of the drum 31, the assembly 1-42 leaves the station 40 while sliding in contact with the pressing member 92 which once it is desengaged by the assembly 1–42 returns to its rest position, and is engaged underneath a guide (not shown) substantially similar to the guide 51 and arranged between the stations 40 and 37 to hold the cutout element 1 in its folded configuration illustrated in FIG. 9 until it reaches the station 37.

When the assembly 1–42 stops at the station 37, the two pushers 118 and 119 are moved under the action of driving means not shown and shown per se until their two plates 114 and 115 are in contact with the panels 17 and 14 to keep in contact with each other the edges of the panels 18 and 13 facing each other. At the same time, the two pairs of adjusting arms 123 are moved by driving means not shown and known per se in contact with the free edges of the panels 28 and the side walls 20 so as to perfectly mutually align them.

At this point, the pusher 120 is moved into contact with the panels 13 and 18, while the pusher 120 is moved forward by the device 122 from a rest position inside the drum 31 into contact with the panels 15 and 16 still resting on the respective seat 35*a*. By means of driving means not shown and known per se, the pusher 121 is then moved in timed relationship with the pusher 120 from the said position so as to extract the assembly 1–42 from its respective recess 32 and insert it in to the passage 119 in the hopper 110. During this displacement, the side walls 20 and the panels 28 engage with the inclined surfaces 116, thereby being progressively folded towards their respective panels 23 and the flaps 24 and coming into contact with them when the assembly 1–42 engages the passage 119. At this point, folding of the cutout element 1 is terminated and the pushers 120 and 121 before returning to their respective rest positions move still further to feed a finished packet to possible devices (not shown) of the above-mentioned packaging machine (not shown), downstream of the folding apparatus 30.

What I claim is:

1. An apparatus for folding cutout elements in machines for packaging articles, in particular cigarettes, to obtain rigid packets of the hinged-lid type, the apparatus comprising:

a step-by-step conveyor moving along a substantially circular path and having a plurality of recesses each of which is designed to receive a respective article together with a respective cutout element;

a plurality of folding stations successively arranged along the said path, each station comprising folding means arranged to cooperate with the said cutout elements to fold the same along pre-formed folding lines and around respective articles, the first of the said stations being an insertion station arranged to insert the said cutout elements inside a respective recess in the conveyor, and the last of the said stations being an outlet or discharge station for discharging the packaged articles from the conveyor; characterized in that each of the said recesses is radially outwardly and laterally open with respect to the said path; and that the said first station comprises:

a folding mandrel or frame arranged in a fixed position outside the said path and delimiting a passage having a cross-section substantially equal to that of the said articles and the said recesses and being oriented in substantially radial direction with respect to the said path;

first pusher means which can reciprocate through the said conveyor when the latter is stationary and radially with respect to the said path, the said pusher means being designed to sequentially cooperate with each of the cutout element arranged with its central portion in contact with an axial end of the said mandrel facing the said conveyor; the said first pusher means having a folding head designed to cooperate with peripheral portions of the said cutout element projecting from opposite sides of said mandrel in a direction parallel to the said path to push the said peripheral portion into contact with said outer surface of said mandrel;

second pusher means designed to successively support the articles to be packaged and being adapted to reciprocate, when the said conveyor is stationary, to move each of the said articles inside the said mandrel and into contact with its respective cutout element;

support means adapted to reciprocate along the said path and to keep each an article and its respective cutout element inside its recess; the said support means having arms designed to cooperate, during motion of the support means, with that part of one of the side folded portions of the said cutout element, projecting from the said recess to fold parallel to the said path; and fixed folding means designed to cooperate during movement of the said conveyor, with the part of the other of the said side folded portions of each of said cutout element, which projects from the said respective recess to fold it parallel to the said path;

folding stations arranged between the said first and the said last folding stations and comprising fixed cam means designed to cooperate with each said cutout element during the movement of the said conveyor; and mobile folding means designed to cooperate with the said cutout elements when the said conveyor is stationary, to fold onto the said article the portions of the said cutout elements which project from the said recesses transversely of the said path;

and the said last station comprising second fixed folding means arranged externally of the said path and designed to complete the formation of the said packets, and ejection means designed to eject partly formed packets from their recesses and in engagement with the said second fixed folding means.

2. A folding apparatus as claimed in claim 1, wherein the said first fixed folding means comprises two arms which are arranged facing and in alignment with the arms of the said mobile support means, and form the end projecting part of two side members of a guide having a substantially U-shaped cross-section and extending along an arc of circumference parallel to the said path and externally thereof; the said two side members extending radially from a curved plate co-axial with the said path and being arranged on opposite sides of the said conveyor, and the said curved plate closing part of the said recesses on the outer side.

3. A folding apparatus as claimed in claim 2, wherein the said fixed cam means is supported by the said guide and comprises a slit laterally extending along the said conveyor to define a cylindrical helix coaxial with the said path; the said slit being warped and having an initial length arranged in the direction of movement of the said conveyor in a plane substantially perpendicular to the axis of the said path, and an end length extending along a surface substantially parallel to the axis of the said path.

4. A folding apparatus as claimed in claim 3, wherein the said initial length of the said slit is tapered towards the said end length and is arranged at a distance from the axis of the said path so as to be successively engaged by one of the portions of each said cutout element projecting from a respective recess transversely of the said path; the said portion of cutout element projecting outwardly from a first cylindrical folding mandrel rigid with the said guide and coaxial thereto.

5. An apparatus for folding cutout elements in machines for packaging articles, in particular cigarettes, to obtain rigid packets of the hinged-lid type, the apparatus comprising in combination:

a drum having a plurality of outer recesses which are open outwardly of the drum in a direction parallel to the axis of the drum; the said drum being rotatable step-by-step about its axis to move forward each said recess from a loading position to an unloading position;

a fixed folding mandrel arranged externally of the said drum at the said loading position and delimiting a passage having a cross-section substantially equal to that of the said articles and the said recesses, and oriented in a radial direction with respect to the said drum; loading means for successivelu feeding, when the drum is stationary, each said article inside a respective recess together with a respective said cutout element having its central portion arranged between the mandrel and the said recess, and to carry out a first folding operation of the said cutout element;

fixed folding means and cyclically movable folding means for carrying out further folding operations of the said cutout elements when the said drum is moving and stationary, respectively;

final fixed folding means for performing the final folding operation of the said cutout element when the said drum is stationary; and unloading means for successively expelling the said packets being formed from respective recesses of the said drum and for pushing them into engagement with the said final folding means; the said loading means comprising a first mobile pusher which can reciprocate in radial direction with respect to the drum and through the recess in it facing the said mandrel, the said pusher having a folding head designed to engage with the said mandrel for folding, into contact with the outer surface of the mandrel, side side portions of the said cutout element projecting outwards from the said mandrel in a direction perpendicular to the axis of the said drum; a second pusher coaxial with the said first pusher and capable of reciprocating to successively feed the said articles to be packaged inside the said mandrel to be then moved in timed relationship with the said first pusher engaging with the said mandrel so as to feed each article and its respective cutout element partly folded inside its respective recess; and a support element cyclically movable in a direction substantially tangential to the said drum to support the said article and its respective cutout element inside the said recess at the said loading position, the said support element having arms designed to fold parts of the said side portions of each said cutout element projecting from its said respective recess in the said loading position in axial direction with respect to the drum; and the said fixed folding means comprising cam means defining a cylindrical helix coaxial with the said drum and designed to engage with an end portion of a part of the said cutout elements which projects from the said recesses in an axial direction with respect to the drum, and to fold it towards the drum so as to arrange it in a plane substantially perpendicular to the axis of the drum.

6. A folding apparatus as claimed in claim 5, wherein the said cyclically movable folding means comprises folding lever means which can reciprocate in a plane parallel to the axis of the said drum to fold an end portion of a further part of the said cutout elements projecting from the said recesses in an axial direction with respect to the drum, and to fold it towards the drum so as to arrange it in a plane substantially perpendicular to the axis of the drum.

7. A folding apparatus as claimed in claim 6, comprising two further fixed folding mandrels arranged laterally of the said drum and having each an edge substantially coinciding with a respective pre-formed folding line of the said cutout elements, around which line the said end portion is folded.

8. A folding apparatus as claimed in claim 6, wherein the said cyclically movable folding means comprises angle folding means arranged downstream of both the said folding lever means and the said fixed folding means in the direction of rotation of the drum, and being capable of reciprocating to engage the said two end parts of each cutout element which project from their respective recess in radial direction with respect to the drum, and to fold them towards their respective said article so as to form a front side wall, a top side wall and a bottom side wall of the said packet.

9. A folding apparatus as claimed in claim 5, wherein the said cam means comprises a side member extending along an arc of a first circumference coaxial with the said drum, the said side member being axially limited by a surface inclined with respect to the axis of the drum, and a rod extending along an arc of a second circumference coaxial with the said first circumference; the said rod being arranged facing at least along an intermediate section thereof the said inclined surface and defining therewith a helical slit coaxial with the said drum.

10. A folding apparatus as claimed in claim 9, wherein the said rod has an initial section having, in the direction of rotation of the said drum, a radius of curvature smaller than that of the said first circumference and defining, together with the said side member, a tapered mouth for the said slit; the said mouth being arranged in a plane perpendicular to the axis of the drum, and the distance from the axis of the drum of a bottom surface of the said recesses in the drum being smaller than the radius of the said first and said second circumference and greater than the distance between the axis of the drum and an initial end the said initial section of the rod.

11. A machine for packaging articles, in particular cigarettes, in rigid packets of the hinged-lid type, and comprising a folding apparatus designed to form each said packet starting from a planar cutout element having a substantially rectangular configuration with two preformed longitudinal folding lines (2, 3) and a plurality of preformed transverse folding lines (7, 8, 9, 10, 11, 12) which define, together with said longitudinal folding lines (2, 3) and therebetween, in sequence, a first front panel (13), a bottom panel (14), a first and a second rear panel (15, 16), a top panel (17) and a second front panel (18) of the said packet; said transverse folding lines (7, 8, 9, 10, 11, 12) defining along each longitudinal side of said cutout element and outside each said longitudinal folding line (2, 3) in sequence, a first side panel (20), a first stiffening flap (21) to stiffen said bottom panel (14), a first side stiffening panel (23) to stiffen said first side panel, a second side stiffening panel (24), a second stiffening flap (26) designed to cooperate with the said top panel (17), and a second side panel (28) stiffened by said second side stiffening panel (24); said first and second stiffening flaps (21, 26) being respectively connected to the said first and said second side stiffening panels (23, 24) and being separated from the remaining panels adjacent thereto by means of respective cuts (22, 27) formed in the said cutout element; the packaging machine being characterized in that said folding apparatus is designed to sequentially cooperate with each said cutout element and has a plurality of folding means operating in the following sequence and comprising:

first feeding and folding means to feed each said cutout element and its respective said article to the said folding apparatus, and to fold at the same time through substantially 90° about the said two longitudinal folding lines, the said first and second stiffening flaps and the said first and second side stiffening panels against the article;

second folding means for folding one of the said first and one of the said second stiffening flaps through substantially 90° with respect to their respective folded first and second side stiffening panels against the article;

third folding means for folding the other of the said first and the other of the said second stiffening flaps through substantially 90° with respect to their respective folded first and second side stiffening panels against the article and towards respective first and second flaps already folded;

fourth folding means for folding the said first front panel and said two first side panels through substantially 90° about a first said transverse folding line with respect to the said bottom panel and on the same side of the said stiffening flaps with respect to the said rear panels;

fifth folding means for folding the said second front panel and the said two second side panels through substantially 90° about a second said transverse folding line with respect to the said top panel and in a position facing the said first front panel folded by the said fourth folding means;

sixth folding means for folding the said bottom and top panels through substantially 90°, one towards the other and about a third and a fourth respective transverse folding line with respect to the said rear panels and into contact, respectively, with the said first and said second stiffening flaps with said first and second panels moving into contact with the article; and seventh folding means for folding the said first and said second side panels through substantially 90° about the said longitudinal folding lines and in contact with said respective first and second side stiffening panels.

12. A machine as claimed in claim 11, wherein part of said folding means is fixed, while the remainder folding means are cyclically movable.

13. A machine as claimed in claim 11, wherein the said third, fourth and seventh folding means are fixed, first and second transport means being provided to carry the said cutout elements into engagement with the said third and fourth folding means, and with the said seventh folding means, respectively.

14. A machine as claimed in claim 13, wherein the said folding means are distributed along the said transport means.

* * * * *